US010774493B2

(12) United States Patent
Aschenbroich

(10) Patent No.: US 10,774,493 B2
(45) Date of Patent: Sep. 15, 2020

(54) HOLLOW REBAR FOR POST-GROUTING THE BASE OF REINFORCED CONCRETE DRILLED SHAFTS

(71) Applicant: Horst K. Aschenbroich, Surrey (CA)

(72) Inventor: Horst K. Aschenbroich, Surrey (CA)

( * ) Notice: Subject to any disclaimer, the term of this patent is extended or adjusted under 35 U.S.C. 154(b) by 0 days.

(21) Appl. No.: 16/193,718

(22) Filed: Nov. 16, 2018

(65) Prior Publication Data

US 2020/0157756 A1 May 21, 2020

(51) Int. Cl.
*E02D 5/62* (2006.01)
*E02D 5/36* (2006.01)
*E02D 27/12* (2006.01)

(52) U.S. Cl.
CPC ..... *E02D 5/36* (2013.01); *E02D 5/62* (2013.01); *E02D 27/12* (2013.01); *E02D 2250/0023* (2013.01); *E02D 2300/002* (2013.01); *E02D 2300/0026* (2013.01)

(58) Field of Classification Search
CPC ..... E02D 5/62; E02D 7/28
See application file for complete search history.

(56) References Cited

U.S. PATENT DOCUMENTS 3,241,325 A * 3/1966 Simons ..... E02D 5/30 405/237
5,372,195 A * 12/1994 Swanson ..... E21B 43/26 166/281
6,783,273 B1 * 8/2004 Mullins ..... G01N 25/4833 374/137
7,909,541 B1 3/2011 Beck et al.
9,074,473 B2 7/2015 Alter et al.
9,732,585 B2 * 8/2017 Lucido ..... E21B 33/13
2007/0237587 A1 * 10/2007 Mullins ..... E02D 3/12 405/266
2010/0178115 A1 * 7/2010 McVay ..... E02D 5/44 405/237
2011/0056303 A1 * 3/2011 Hayes ..... G01M 99/007 73/788

(Continued)

FOREIGN PATENT DOCUMENTS

CN 108166486 * 6/2018

OTHER PUBLICATIONS

CTS/Titan Injection Bore System, p. 17-19, Nov. 2006.*

*Primary Examiner* — Frederick L Lagman
(74) *Attorney, Agent, or Firm* — Muirhead and Saturnelli, LLC

(57) ABSTRACT

Performing post-grouting of a drilled shaft includes forming the drilled shaft using a plurality of hollow rebar tubes, where each of at least one pair of hollow rebar tubes has a central longitudinal opening, coupling the at least one pair of hollow rebar tubes to a grout delivery mechanism disposed below the shaft, and providing grout to the grout delivery system through the at least one pair of hollow rebar tubes. Each of the at least one pair of hollow rebar tubes may include threads or ridges that eliminate debonding of the hollow rebar tubes from concrete of the drilled shaft. The hollow rebar tubes may be TITAN 52/26, TITAN 73/53 and/or TITAN 73/56 hollow threaded rebar. Each of the at least one pair of hollow rebar tubes may further provide structural reinforcement of the drilled shaft. The grout delivery mechanism may include a perforated pipe.

18 Claims, 4 Drawing Sheets

(56) References Cited

U.S. PATENT DOCUMENTS

| | | | | |
|---|---|---|---|---|
| 2015/0276702 | A1* | 10/2015 | England | G01N 33/383 374/4 |
| 2016/0115763 | A1* | 4/2016 | Lucido | E21B 33/13 166/177.4 |
| 2017/0067222 | A1* | 3/2017 | Bell | E21B 47/0005 |

* cited by examiner

FIG. 1
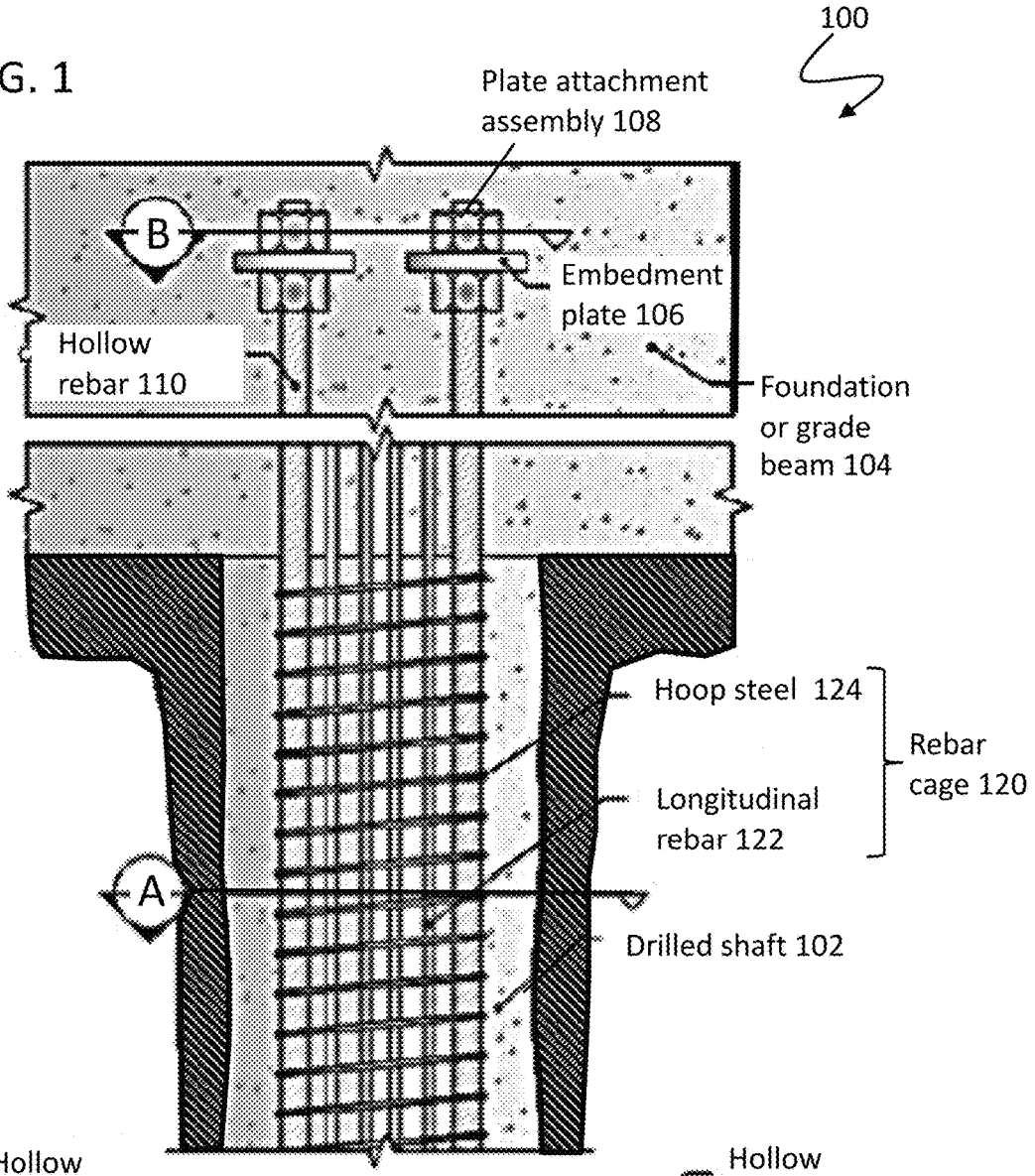
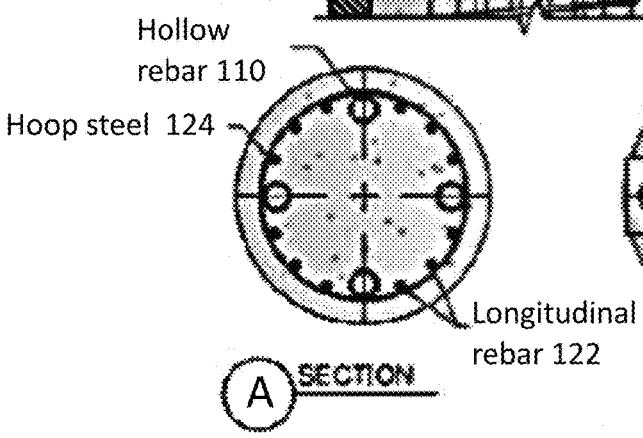
FIG. 2A
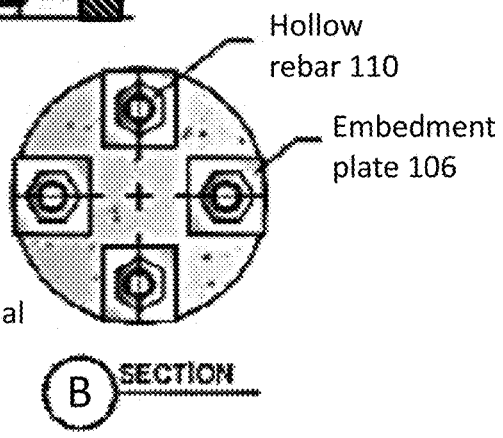
FIG. 2B

HOLLOW REBAR FOR POST-GROUTING THE BASE OF REINFORCED CONCRETE DRILLED SHAFTS

TECHNICAL FIELD

This application is related to the field of reinforced concrete drilled shafts and more particularly to post-grouting the base of reinforced concrete drilled shafts.

BACKGROUND OF THE INVENTION

Post-grouting, or tip or base grouting, refers to a variety of practices related to injection of grout under pressure below the tip of a drilled shaft foundation to improve the stiffness and nominal resistance of a shaft to top-down loading when subjected to compressive axial load. The grout may be neat cement grout (i.e., Portland cement and water). Post-grouting may be accomplished using a grout delivery system that is incorporated into a drilled shaft during construction. The grout delivery system generally includes one or more tubes or pipes that pass from the top of the shaft to a grout distribution apparatus located at the tip of the shaft. When adequately instrumented and properly monitored, the post-grouting process is believed to provide increased reliability compared to conventional (ungrouted) drilled shafts, since the process provides a measurable indication of performance.

Post-grouting requires delivery of grout material after the drilled shaft foundation has been installed. Pipes that run the length of the drilled shaft that are used to deliver the grout material are added and permanently remain part of the completed shaft. Providing the additional pipes is an additional expense that adds to undesirable congestion of the steel reinforcement cage used for the drilled shaft foundation. Furthermore, once post-grouting is complete, the pipes used for post-grouting provide no structural contribution to the drilled shaft foundation and thus are a relatively inefficient component thereof.

Accordingly, it is desirable to provide a more efficient mechanism for using a post-grout delivery system of a drilled shaft foundation.

SUMMARY OF THE INVENTION

According to the system described herein, performing post-grouting of a drilled shaft includes forming the drilled shaft using a plurality of hollow rebar tubes, where each of at least one pair of hollow rebar tubes has a central longitudinal opening, coupling the at least one pair of hollow rebar tubes to a grout delivery mechanism disposed below the shaft, and providing grout to the grout delivery system through the at least one pair of hollow rebar tubes. Each of the at least one pair of hollow rebar tubes may include threads or ridges that eliminate debonding of the hollow rebar tubes from concrete of the drilled shaft. Each of the at least one pair of hollow rebar tubes may be TITAN 52/26 hollow threaded rebar, TITAN 73/53 hollow threaded rebar, or TITAN 73/56 hollow threaded rebar. Each of the at least one pair of hollow rebar tubes may further provide structural reinforcement of the drilled shaft. The grout delivery mechanism may include a perforated pipe. The perforated pipe may be u-shaped. The perforated pipe may be coupled to the at least one pair of hollow rebar tubes using rubber sleeves. The grout delivery mechanism may include a basket of gravel sandwiched between two steel plates. The grout delivery mechanism may be a flat-jack system or a RIM-Cell (Reliability Improvement Method Cell) system. At least one of the plurality of hollow rebar tubes that is used for post-grouting may also be used for CSL (Crosshole Sonic Logging) ultrasonic inspection.

According further to the system described herein, a system for reinforcing a drilled shaft includes at least one pair of hollow rebar tubes has a central longitudinal opening that provides access to a grout delivery system beneath the drilled shaft and at least one other support provided in the drilled shaft, where the at least one pair of hollow rebar tubes and the at least one other support provide structural reinforcement to the drilled shaft according to a cross-sectional area of the at least one pair of hollow rebar tubes and the at least one other support. Each of the at least one pair of hollow rebar tubes may include threads or ridges that eliminate debonding of the hollow rebar tubes from concrete of the drilled shaft. Each of the at least one pair of hollow rebar tubes may be may be TITAN 52/26 hollow threaded rebar, TITAN 73/53 hollow threaded rebar, or TITAN 73/56 hollow threaded rebar. Each of the at least one pair of hollow rebar tubes may further provide structural reinforcement of the drilled shaft. The grout delivery mechanism may include a perforated pipe. The perforated pipe may be u-shaped. The perforated pipe may be coupled to the at least one pair of hollow rebar tubes using rubber sleeves. The grout delivery mechanism may include a basket of gravel sandwiched between two steel plates. The grout delivery mechanism may be a flat-jack system or a RIM-Cell system. At least one of the plurality of hollow rebar tubes that is used for post-grouting may also used for CSL ultrasonic inspection.

BRIEF DESCRIPTION OF THE DRAWINGS

Embodiments of the system described herein are explained with reference to the several figures of the drawings, which are briefly described as follows.

FIG. 1 is a schematic cross-sectional illustration showing use of hollow rebar in a drilled shaft to provide a CSL access tube according to an embodiment of the system described herein.

FIGS. 2A and 2B are schematic illustrations showing sectional views taken from sections A and B, respectively, of FIG. 1.

DETAILED DESCRIPTION OF VARIOUS EMBODIMENTS

Figure 3:
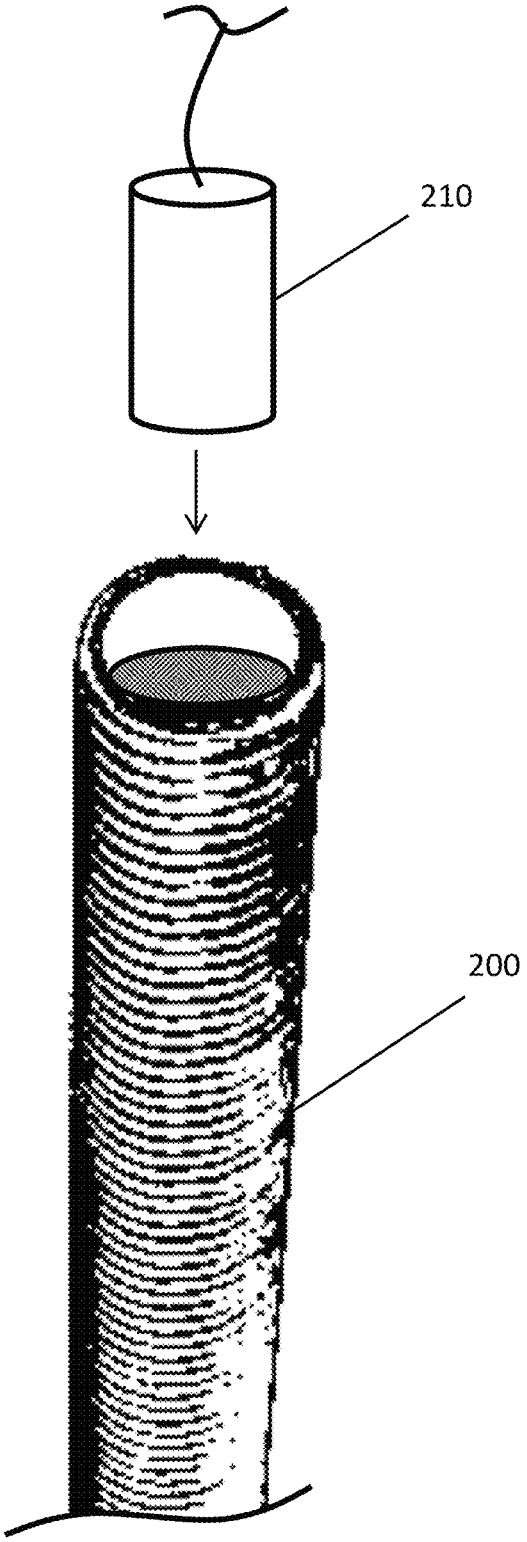
FIG. 3 is a schematic illustration showing insertion of a CSL probe into a hollow threaded rebar that is functioning as an access tube used in connection with CSL according to an embodiment of the system described herein.

In performing CSL of drilled shafts with current techniques, known cross hole sonic access tubes, such as 1½" or 2" ID tubes, installed inside the steel reinforcement cage do not contribute to the structural capacity of the drilled shaft. According to the system described herein, hollow rebar may be used for structural reinforcement in a drilled shaft and to provide access tubes for a CSL probe. Rebar (short for reinforcing bar) is steel bar used as a tensioning device in reinforced concrete that holds the concrete in compression. According to the system described herein, hollow rebar may provide high strength reinforcement in the drilled shaft while at the same time providing a CSL sonic access tube. Further, it is noted that, in various embodiments, the high strength hollow rebar, having ridges, threads and/or other appropriate surface deformations, provides improved adhesion to concrete, thus eliminating the problem of debonding associated with non-structural access tubes made of smooth PVC or steel pipe. In addition, it is possible to use the hollow rebar to perform post-grouting.

The use of hollow rebar for shaft reinforcement and as an access tube for CSL (and similar) and/or for post-grouting may provide a value engineering alternative that may both reduce material and labor costs for drilled shaft construction and may provide an advantage where anchor bolt cages and longitudinal reinforcing may create undesirable congestion. Drilled shafts for transmission line construction may also benefit from the use of hollow rebar access tubes according to the system described herein, especially where tower anchor bolt cages conflict with the longitudinal reinforcing in the drilled shaft. It is noted that although CSL is principally discussed herein, the system described herein may also be used in connection with other appropriate inspection techniques involving use of access tubes, such as Gamma Logging (GGL). Accordingly, references to CSL herein may be understood to apply also to such other appropriate inspection techniques.

In an embodiment, the hollow rebar used in connection with the system described herein may be Ischebeck TITAN 73/56 (T73/56) hollow threaded rebar and may provide a 56 mm ID (2.2") sonic access tube.

Table 1, below, shows an example of CSL/Hollow Threaded Rebar properties.

TABLE 1

CSL/Hollow Threaded Rebar Properties

| | | Load Capacity | | | Outside Diameter | | |
|---|---|---|---|---|---|---|---|
| Rod size<br>D Ø/Inner<br>Ø mm | Area<br>$in^2$<br>$mm^2$ | Ultimate<br>G.U.T.S.<br>kips<br>kN | Yield<br>kips<br>kN | Max. Test<br>kips<br>kN | Effective<br>d Ø<br>in<br>mm | Nominal<br>D Ø<br>in<br>mm | Weight<br>lbs/lf<br>kg/m |
| 73/56 | 2.11 | 232.7 | 186.6 | 185.5 | 2.76 | 2.87 | 7.3 |
| R.H. Thread | 1360 | 1035 | 830 | 825 | 70 | 73 | 10.8 |

T73/56 hollow rebar may provide continuous access tube segments that can be coupled to any required length, and the couplings may be watertight with rubber seals to prevent leakage. The T73/56 hollow rebar is structural high grade steel that may replace or augment the longitudinal reinforcing steel required for axial load design, as further discussed in detail elsewhere herein. Deformations on T73/56 and material stiffness may provide desirable resistance to debonding and produce consistent CSL results. Although use of T73/56 rebar is principally discussed herein, it is noted that in other embodiments, other types of hollow rebar may be used according to desired construction techniques and according to desired diameters of the access tube in connection with particular ultrasonic inspection techniques that may be suitably performed according to the system described herein.

FIG. 1 is a schematic cross-sectional illustration of a system 100 including hollow rebar 110 providing an access tube and reinforcing a drilled shaft 102 according to an embodiment of the system described herein. The hollow rebar 110 may be attached in a foundation or grade beam 104 via an embedment plate 106 and a plate attachment assembly 108, such as top and bottom nuts and bolts. The hollow rebar 110 is disposed inside of a rebar cage 120, including longitudinal rebar 122 for structural reinforcement and reinforcing hoop steel 124. According to the system described herein, the hollow rebar 110 is used both for structural reinforcing rebar of the drilled shaft 102 and to provide an access tube for a probe and/or other appropriate ultrasonic testing procedure probe and/or to facilitate post-grouting. It is noted that, in an embodiment, all access tubes provided for the CSL, and/or other sonic integrity testing, and/or post-grouting may be the hollow rebar 110 that is further providing structural reinforcement of the drilled shaft 102.

FIGS. 2A and 2B are schematic illustrations showing sectional views taken from sections A and B, respectively, of FIG. 1. In FIG. 2A, four hollow rebar access tubes 110 are shown disposed evenly around the rebar cage 120 with respect to the longitudinal rebar 122 (three each disposed evenly between the hollow rebar 110) and surrounded by the reinforcing hoop steel 124. FIG. 2B shows a view of the attachment of the hollow rebar 110 to the embedment plate 106 in the foundation or grade beam 104.

The following description provides a specific implementation of an embodiment for the system described herein using T73/56 hollow threaded rebar. A T73/56 hollow threaded rebar/access tube has 2.11 sq. in. of area, approximately equal to use of two #9 rebar (A=1.00 sq. in. each). In an embodiment, three each of T73/56 hollow threaded rebar may be used to replace some of the other rebar that would normally be required while also providing sonic access tubes and/or post-grouting access tubes. For example, for a 3'-0" drilled shaft, total reinforcing requirements under applicable codes are 14 sq. in. steel area. By using three T73/56 rebars, three access tubes are provided in addition to providing a steel rebar area of 6.33 sq. in., thereby reducing the required steel area for other longitudinal rebar to 14-6.33=7.67 sq. in. The steel area requirement may then be met, for example, by further using eight each of #9 rebar (A=1.00 sq. in. each) which equals an area of 8.00 sq. in. (which is acceptably greater than 7.67 sq. in.). Without the use of the three T73/56 hollow threaded rebars, fourteen #9 rebars would be required for the required steel rebar total area (14 sq. in.).

Table 2, below, shows statistics for the use of Hollow threaded rebar compared to known longitudinal reinforcing techniques with use of additional non-structural access tubes.

TABLE 2

CSL/Hollow Threaded Rebar vs. Known Longitudinal Reinforcing

| | CSL Hollow Threaded Rebar | | Known Longitudinal Reinforcing | |
|---|---|---|---|---|
| | Pieces to assemble | steel area [$in^2$] | Pieces to assemble | steel area [$in^2$] |
| Number of #9 rebar | 8 | 8.00 | 14 | 14.00 |
| Number of additional non-structural access tubes | — | — | 3 | — |
| Number of hollow threaded rebar | 3 | 6.33 | — | — |
| Total | 11 | 14.33 | 17 | 14.00 |

In a possible configuration, the #9 bars may be disposed between the three equally spaced T73/56 hollow rebar/access tubes around the circumference of the rebar cage. In this configuration, there is a total of 11 pieces to assemble (three T73/56 hollow rebar+eight #9 rebar) which is easier to install, less costly and more efficient than using, for example, fourteen #9 rebar plus three additional non-structural smooth PVC/steel access tubes (see Table 2). It is noted that the T73/56 hollow rebar may be subsequently filled with cement grout to produce a composite structural section. In the illustrated example, approximately 45% of the total steel area to be provided for longitudinal structural reinforcing by rebar is made up of the hollow rebar that also provides access tubes for the CSL and/or for post-grouting. This percentage portion of the required steel area provided by hollow rebar may be varied according to specific design considerations and requirements. In an embodiment, a desirable range for the percentage portion may be between 30% and 60%, for example. In other embodiments, this range may be adjusted depending on the number of access tubes desired and/or other considerations. For example, in an embodiment, one access tube may be provided per foot of diameter of the rebar cage of the drilled shaft.

FIG. 3 is a schematic illustration showing insertion of a CSL probe 210 into a hollow threaded rebar 200 that is functioning as an access tube used in connection with CSL according to an embodiment of the system described herein. Accordingly, T73/56 rebar may be used for drilled shaft sonic access tubes and longitudinal reinforcing and thereby serves two purposes while reducing labor and material cost for CSL access, as discussed in detail elsewhere herein. The system described herein provides an opportunity for value engineering of conventional drilled shaft construction and design methods and permitting larger windows in reinforcing for concrete to pass through and providing a larger encompassed area to be tested. Debonding of sonic tubes is reduced or eliminated as hollow threaded bars perform as rigid reinforcing. Further, it is noted that the hollow bar (e.g., having a nominal 3" outer diameter) may be much stiffer than normal rebar thereby facilitating rebar cage handling.

Figure 4A:
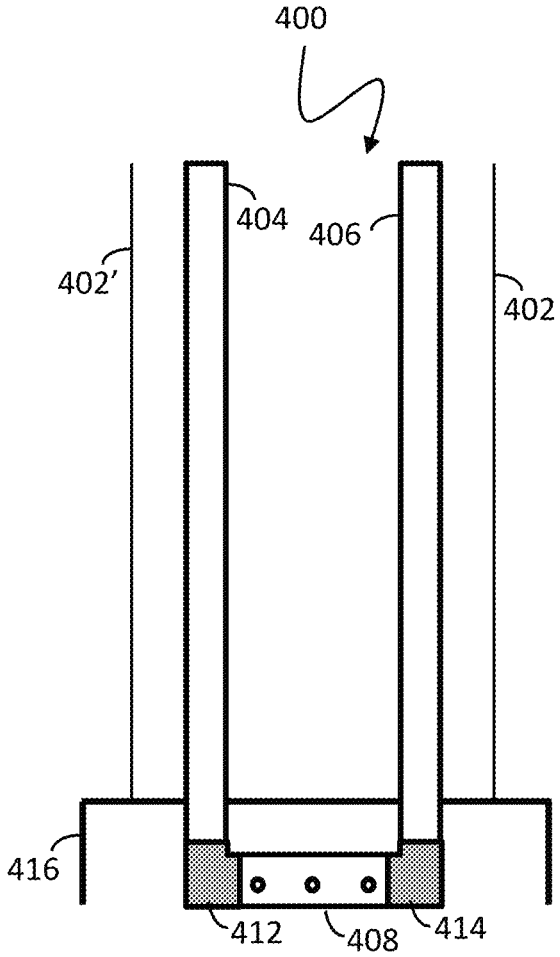
FIG. 4A is a schematic illustration showing using a hollow rebar for post-grouting according to an embodiment of the system described herein.

FIG. 4A illustrates a shaft 400 having a rebar reinforcement cage with outer edges 402, 402'. The rebar reinforcement cage contains a pair of hollow rebar tubes 404, 406 that are used for post-grouting. The hollow rebar tubes may be Ischebeck TITAN 52/26 (T52/26), Ischebeck TITAN 73/53 (T73/53), or Ischebeck TITAN 73/56 (T73/56) or any other appropriate hollow rebar tubes having any appropriate inside and outside diameters based on structural needs. Each of the hollow rebar tubes 404, 406 may include threads or ridges that eliminate debonding of the hollow rebar tubes 404, 406 from concrete of the drilled shaft 400. The hollow rebar tubes 404, 406 are coupled to a perforated pipe 408, such as a steel pipe, by a pair of rubber sleeves 412, 414, although any appropriate coupling mechanism may be used. The perforated pipe 408 may be u-shaped, although any appropriate shape may be used. The perforated pipe 408 is beneath the shaft 400 and acts as a grout delivery mechanism. A plate 416 may be used to facilitate the post-grouting by maintaining the grout that is forced through the hollow rebar tubes 404, 406 proximal to a bottom portion of the shaft 400. Note that the system described herein may be used with either open-type systems in which grout directly contacts the ground upon injection at the tip of the shaft 400 or closed-type systems in which the grout is contained within a variable-volume chamber (not shown in FIG. 4) and does not contact the ground directly. In an embodiment herein, the grout that is provided under pressure through the hollow rebar tubes 404, 406 is neat cement grout (i.e., Portland cement and water) although other types of grout are possible. Note that any number of hollow rebar tubes may be used in a shaft for post-grouting. Also, in some embodiments, it is possible to maintain grout in the hollow rebar tubes 404, 406 following the post-grouting process so that the hollow rebar tubes 404, 406 will contain grout after the shaft 400 is completed.

Figure 4B:
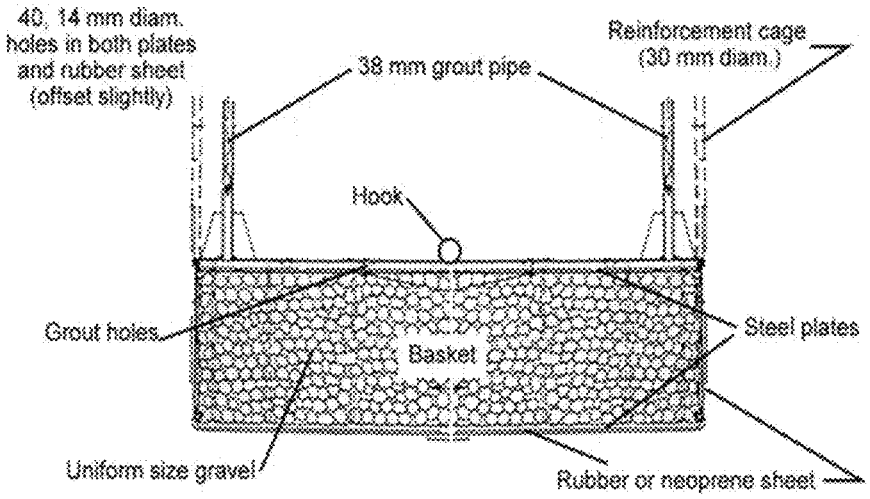
FIG. 4B is a schematic illustration of a grout delivery system according to an embodiment of the system described herein.

FIG. 4B illustrates an alternative grout delivery mechanism that may be used for post-grouting in place of the pipe 408. In FIG. 4B a basket of gravel is sandwiched between two steel plates. The basket is attached to an end of the rebar cage and encapsulated by a rubber sheet. Both the steel plates and rubber sheet are perforated with holes that are located in different positions to prevent backflow of the grout. Another possibility is the so-called "flat-jack" system (not shown) that uses a steel plate that is covered with an impermeable membrane to provide a closed grout delivery mechanism. In other embodiments, a RIM-Cell may be used in connection with post-grouting. Note that, generally, any appropriate grout delivery mechanism may be used in place of the pipe 408 in connection with the hollow rebar tubes 404, 406 used for post-grouting according to the system described herein.

Figure 5:
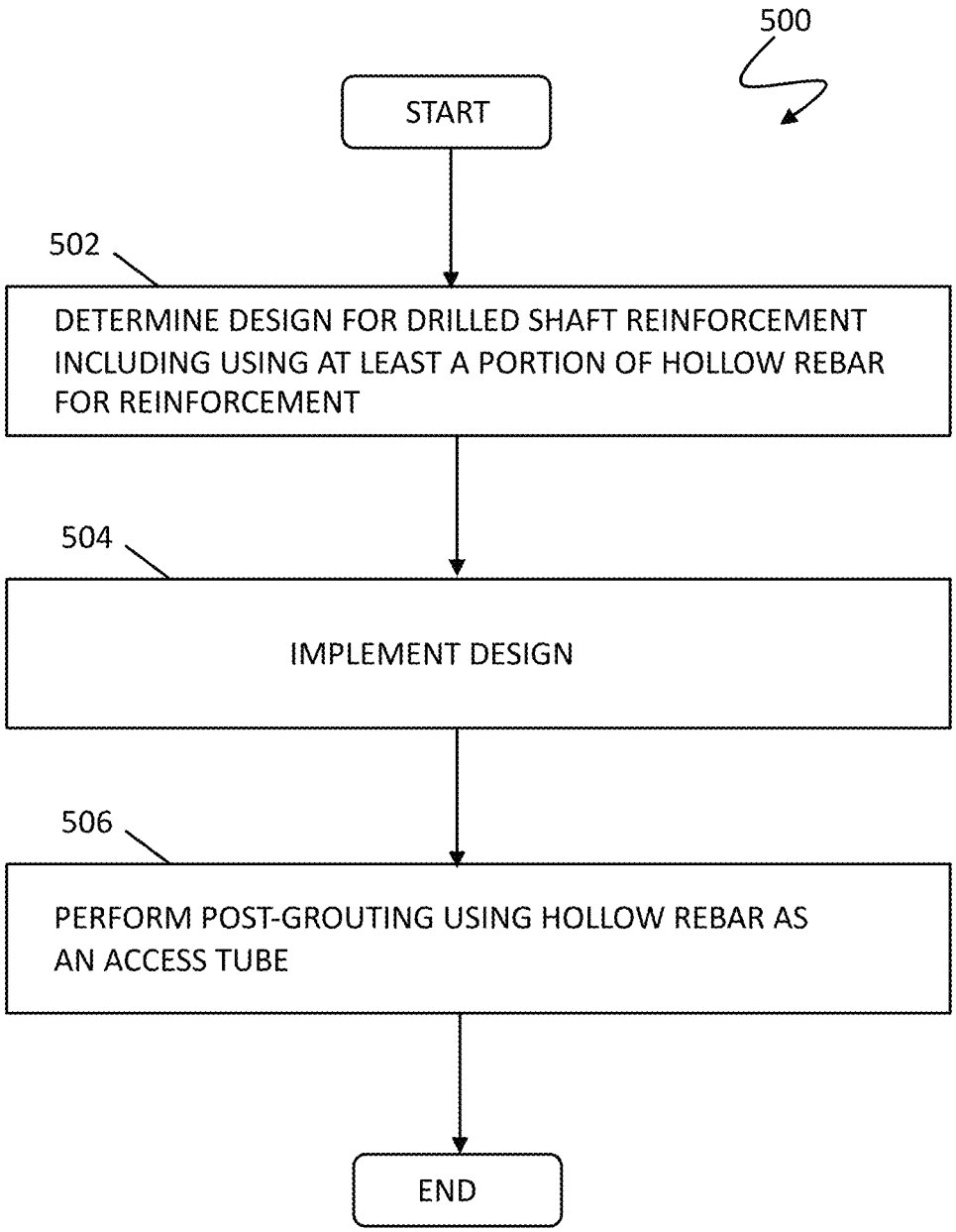
FIG. 5 is a flow diagram showing processing steps in connection with using a hollow rebar for post-grouting according to an embodiment of the system described herein.

FIG. 5 is a flow diagram 500 showing processing steps in connection with installing and using hollow rebar for post-grouting according to an embodiment of the system described herein. At a step 502, a design for structural reinforcement of a drilled shaft is determined in which a portion of reinforcing rebar used to reinforce a drilled shaft is to be instead replaced with hollow rebar, such as T73/56 hollow threaded rebar. The determination may be made according to applicable codes and standards for structural reinforcement design of a drilled shaft having desired dimensions. After the step 502, processing proceeds to a step 504 where reinforcing of the drilled shaft is implemented according to the structural reinforcement design that includes the replacement of a portion of longitudinal rebar with the hollow threaded rebar. After the step 504, processing proceeds to a step 506 where the hollow threaded rebar implemented in the drilled shaft reinforcement design is used as an access tube in connection with performing post-grouting. After the step 506, processing is complete. Note that, in some cases, a particular hollow rebar tube may be used for both post-grouting and for ultrasonic inspection (e.g., CSL testing), described, for example, in connection with FIG. 3, and the corresponding text. Generally, the ultrasonic inspection may be performed prior to post-grouting.

Various embodiments discussed herein may be combined with each other in appropriate combinations in connection with the system described herein. Additionally, in some instances, the order of steps in the flowcharts, flow diagrams and/or described flow processing may be modified, where appropriate.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method of performing post-grouting of a concrete drilled shaft, comprising:

forming the concrete drilled shaft using a plurality of hollow rebar tubes that provides structural reinforcement of the concrete drilled shaft, wherein each of at least one pair of hollow rebar tubes has a central longitudinal opening;

coupling the at least one pair of hollow rebar tubes to a grout delivery mechanism disposed below the shaft; and providing grout to the grout delivery system through the at least one pair of hollow rebar tubes, wherein at least one of the plurality of hollow rebar tubes that is used for post-grouting is also used for CSL (Crosshole Sonic Logging) ultrasonic inspection.

2. The method, according to claim 1, wherein each of the at least one pair of hollow rebar tubes includes threads or ridges that eliminate debonding of the hollow rebar tubes from concrete of the concrete drilled shaft.

3. The method, according to claim 1, wherein each of the at least one pair of hollow rebar tubes is one of: TITAN 52/26 hollow threaded rebar, TITAN 73/53 hollow threaded rebar, or TITAN 73/56 hollow threaded rebar.

4. The method, according to claim 1, wherein the grout delivery mechanism includes a perforated pipe.

5. The method, according to claim 4, wherein the perforated pipe is u-shaped.

6. The method, according to claim 4, wherein the perforated pipe is coupled to the at least one pair of hollow rebar tubes using rubber sleeves.

7. The method, according to claim 1, wherein the grout delivery mechanism includes a basket of gravel sandwiched between two steel plates.

8. The method, according to claim 1, wherein the grout delivery mechanism is one of: a flat-jack system or a RIM-Cell (Reliability Improvement Method Cell) system.

9. The method, according to claim 1, further comprising:

maintaining the grout in the hollow rebar tubes following providing the grout so that the hollow rebar tubes contain grout after the concrete drilled shaft is completed to produce a composite structural section.

10. A system for reinforcing a concrete drilled shaft, comprising:

at least one pair of hollow rebar tubes has a central longitudinal opening that provides access to a grout delivery system beneath the concrete drilled shaft and provides structural reinforcement of the concrete drilled shaft; and at least one other support provided in the drilled shaft, wherein the at least one pair of hollow rebar tubes and the at least one other support provide structural reinforcement to the drilled shaft according to a cross-sectional area of the at least one pair of hollow rebar tubes and the at least one other support and wherein at least one of the plurality of hollow rebar tubes that is used for post-grouting is also used for CSL (Crosshole Sonic Logging) ultrasonic inspection.

11. The system, according to claim 10, wherein the at least one hollow rebar includes threads or ridges that eliminate debonding of the hollow rebar from concrete of the concrete drilled shaft.

12. The system, according to claim 10, wherein the at least one hollow rebar is one of: TITAN 52/26 hollow threaded rebar, TITAN 73/53 hollow threaded rebar, or TITAN 73/56 hollow threaded rebar.

13. The system, according to claim 10, wherein the grout delivery mechanism includes a perforated pipe.

14. The system, according to claim 13, wherein the perforated pipe is u-shaped.

15. The system, according to claim 13, wherein the perforated pipe is coupled to the at least one pair of hollow rebar tubes using rubber sleeves.

16. The system, according to claim 10, wherein the grout delivery mechanism includes a basket of gravel sandwiched between two steel plates.

17. The system, according to claim 10, wherein the grout delivery mechanism is one of: a flat-jack system or a RIM-Cell (Reliability Improvement Method Cell) system.

18. The system, according to claim 10, wherein at least one of the hollow rebar tubes maintains the grout therein following providing the grout so that the hollow rebar tubes contain grout after the concrete drilled shaft is completed to form a composite structural section.

* * * * *